US005245327A

United States Patent [19]

Pleva et al.

[11] Patent Number: 5,245,327

[45] Date of Patent: * Sep. 14, 1993

[54] COLOR TO MONOCHROME CONVERSION

[75] Inventors: Robert M. Pleva, Livermore; Martin Randall, Santa Cruz, both of Calif.

[73] Assignee: Chips and Technologies, Incorporated, San Jose, Calif.

[ * ] Notice: The portion of the term of this patent subsequent to Dec. 11, 2007 has been disclaimed.

[21] Appl. No.: 584,308

[22] Filed: Sep. 18, 1990

Related U.S. Application Data

[63] Continuation of Ser. No. 409,269, Sep. 18, 1989, Pat. No. 4,977,398, which is a continuation of Ser. No. 144,849, Jan. 15, 1988, abandoned.

[51] Int. Cl.[5] ..... G09G 5/00

[52] U.S. Cl. ..... 345/147; 358/30; 358/166

[58] Field of Search ..... 340/789, 791, 793, 701, 340/703, 767; 358/30, 166, 168, 169, 455, 456

[56] References Cited

U.S. PATENT DOCUMENTS

| | | | |
|---|---|---|---|
| 4,236,175 | 11/1980 | Groothuis | 358/30 |
| 4,382,254 | 5/1983 | Ranalli | 340/744 |
| 4,481,529 | 11/1984 | Kerling | 358/30 |
| 4,688,031 | 8/1987 | Haggerty | 340/793 |
| 4,703,318 | 10/1987 | Haggerty | 346/723 |
| 4,725,833 | 2/1988 | Nakamura | 340/793 |
| 4,727,414 | 2/1988 | Ranf et al. | 358/30 |
| 4,755,954 | 7/1988 | Netter | 364/518 |
| 4,977,398 | 12/1990 | Pleva et al. | 358/166 |

FOREIGN PATENT DOCUMENTS

| | | |
|---|---|---|
| 0192815 | 9/1986 | European Pat. Off. . |
| WO86/03614 | 6/1986 | PCT Int'l Appl. . |

OTHER PUBLICATIONS

A. Gair, *Tonal Values: How to See Them, How to Paint Them*, Quatro Publishing, 1987, pp. 6–7, and 18–33.

P. Norton, *Inside the IBM PC*, Prentice Hall, 1986, pp. 63–64, 170–175, 184–195, 203–207, and 258–260.

*Options & Adapters Technical Reference: IBM Color/-Graphics Monitor Adapter*, publication S229-6912-00, P/N 6322509, commercially available from IBM Corporation, pp. iii–34.

*PC Convertible, Technical Reference*, publication number SA 23-1047, commercially available from IBM Corporation, pp. 2–45 through 2–62.

*Primary Examiner*—Richard Hjerpe

*Attorney, Agent, or Firm*—Townsend and Townsend Khourie and Crew

[57] ABSTRACT

The present invention provides a contrast enhancing method and circuit for mapping color signals into signals for driving a display which is capable of displaying shades of gray. With the present invention a preliminary translation is first made between a foreground-background color combination and the various shades of gray that can be displayed. The contrast or separation between the foreground level of gray and the background level of gray produced by this preliminary translation is then compared to parameters set by the operator. If the preliminary translation provides the desired degree of separation between the foreground and the background gray levels, no further translation takes place; however, if the desired degree of separation was not achieved by the preliminary translation, the system forces further separation between the foreground and background by taking the following action: (a) if the background was darker than the foreground, the background is made still darker and/or the foreground is made still lighter (b) if the background was lighter than the foreground the background is made still lighter and/or the foreground is made still darker.

14 Claims, 4 Drawing Sheets

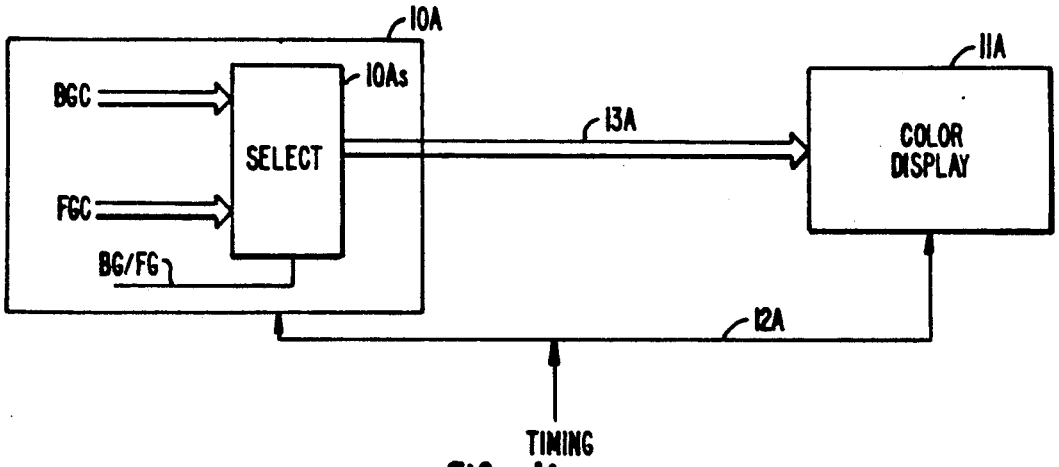
FIG._1A. (PRIOR ART) CGA
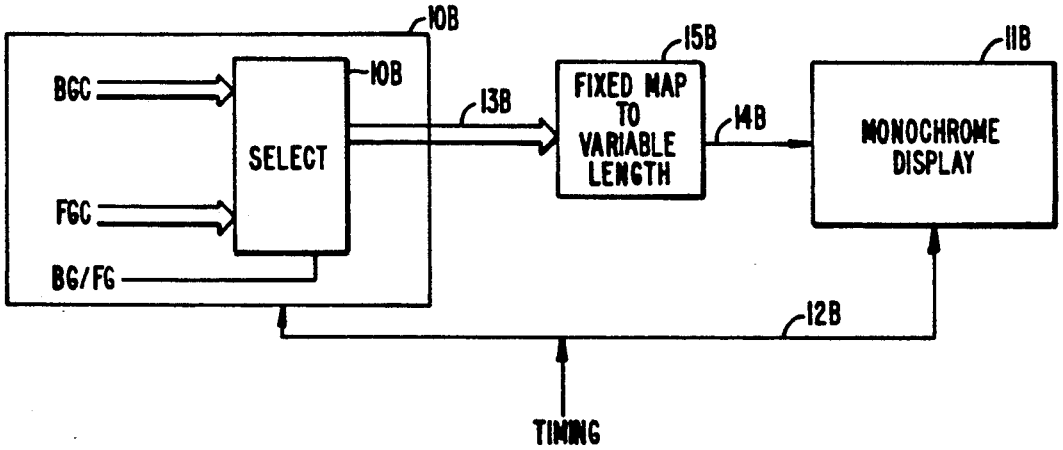
FIG._1B. (PRIOR ART) CGA TO MONOCHROME
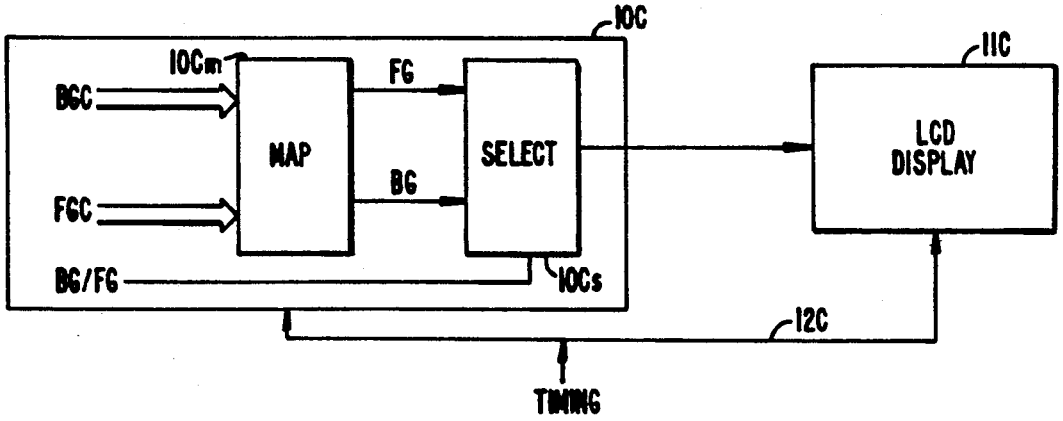
FIG._1C. (PRIOR ART) CGA TO LCD

COLOR TO MONOCHROME CONVERSION

This is a continuation of application Ser. No. 07/409,269, filed Sep. 18, 1989, now U.S. Pat. No. 4,977,398, a continuation of application Ser. No. 07/144,849, filed Jan. 15, 1988, now abandoned.

FIELD OF THE INVENTION

The present invention relates to personal computers and more particularly to method and system for driving a personal computer display that displays shades of gray.

BACKGROUND AND PRIOR ART

Several different types of displays are commonly used with commercially available personal computers. Such displays can be categorized as either monochrome displays or color displays. Some monochrome displays can display shades of gray.

A display is generally connected to a personal computer through a display adapter. There are many different types of display adapters commercially available; however, most of the commercially available display adapters operate in accordance with one of the defacto standards that exist in this area. Among the defacto standards are standards termed Color Graphics Adapter (generally referred to as CGA), the Enhanced Graphics Adapter (generally referred to as EGA), and the Video Graphics Array (generally referred to as VGA). CGA, VGA, and EGA adapters are widely available from a variety of sources. Each of these adapters has a character mode.

When a video adapter is operating in character mode, there are color control bits associated with each data byte. For example, when a CGA is operating in character mode, each data byte has eight color control bits associated therewith. Four of the color control bits control the background color and four of the color control bits control the foreground color. The eight control bits give sixteen possible foreground colors and sixteen possible background colors for the associated character. FIG. 1A shows a CGA 10A driving a color display 11A. In a standard manner (not explicitly shown) the CGA 10A generates (a) a four bit background color control signal designated BGC (b) a four bit foreground color control signal designated FGC and (c) a one bit background or foreground select signal designated BG/FG. The signals BGC, FGC, and BG/FG are provided to a selector 10As which in turn generates a four bit signal 13A which together with timing signals 12A drive the display 11A. As the CRT beam in display 11A scans the various bit positions on the face of the display, the signals 13A indicate the color that should be displayed at each position. Timing signal 12A insures that the signals on line 13A are in synchronization with the scanning of the appropriate bit positions.

Many widely available publications explain the operation of the color control bits in a conventional CGA adapter and the operation of the system shown in FIG. 1A will not be explained further herein. For more information see a book entitled *Inside the IBM PC* by Peter Norton which was published by Prentice Hall, 1986 or see a publication entitled "Options and Adapters Technical Reference" publication S229-9612-00 part number 6322509, commercially available from the IBM Corporation.

It is well known that a Color Graphic Adapter, that is, a CGA adapter, operating in character mode can be used to drive a monochrome display. This can be done in a number of different ways. FIG. 1B illustrates one prior art technique for driving a monochrome display 11B from a CGA adapter 10B Monochrome display 11B is driven by a one bit on-off signal 14B which indicates if each pixel on the face of the display should be "on" or "off". In normal operation of a monochrome display the "on" and "off" duty cycles of signal 14B are fixed. CGA 10B generates a four bit color control signals 13B that is identical to signal 13A in FIG. 1A. With the system shown in FIG. 1B, a mapping circuit 15B translates each of the four bit signals on line 13B into a different duty cycle for the signals on line 14B. Thus one color combination on line 13A would generate a long "on" signal on line 14B, whereas a different color combination on line 13B would generate a short signal "on" signal on line 14B. Changing the duty cycle of the signal on line 14B has the effect of producing gray scale signals on display 11B

FIG. 1C shows an example of a prior art system where a CGA drives a Monochrome LCD Display. In the prior art system shown in FIG. 1C, the eight bits of the BGC and FGC signals are mapped into a single bit foreground color signal FG and a background color signal BG. Circuit 10Cs then selects either signal FG or BG in response to signal BG/FG. A single bit signal then goes to LCD display 11C. This type of circuit is, for example, used in a personal computer sold by IBM Corporation under the trademark "PC CONVERTIBLE". For an explanation of how signals are mapped from color to monochrome in the IBM PC Convertible, see a publication commercially available from the IBM Corporation entitled *PC Convertible, Technical Reference* publication number SA 23-1047, page 2–47 et seq.

As indicated above, in systems where a CGA adapter is used to drive a monochrome display, the sixteen possible foreground colors and the sixteen possible background colors generated by the CGA must be mapped into foreground and background signals available with the monochrome display. For example, in the simplest situation the sixteen foreground and the sixteen background color possibilities from the CGA must be mapped into four "on" and "off" foreground-background possibilities available on a simple monochrome display. If the monochrome display can show different intensities or shades of gray, the number of possibilities on the display may be larger than four; however, there still must be a mapping of color into intensity or gray scale signals.

In the prior art, the mapping from the color signals generated by a video adapter into the signals adapted to drive a monochrome display is done in a manner that is fixed by the design of the machine. Such systems are not very flexible and they do not take into account different user preferences. Furthermore, in order to map all possible foreground-background combinations into a wide variety of gray scale combinations, a substantial amount of logic must be used, hence, in most prior art systems, all possible color combinations are mapped into only a few gray scale values.

SUMMARY OF THE INVENTION

The present invention provides a contrast enhancing method and circuit for mapping color signals into signals for driving a display which is capable of displaying shades or levels of gray.

With the present invention a preliminary translation is first made between a foreground-background color combination and levels of gray that can be displayed. The contrast or separation between the foreground level of gray and the background level of gray produced by this preliminary translation is then compared to parameters set by the operator.

If the preliminary translation provides the desired degree of separation between the foreground and the background gray levels, no further translation takes place; however, if the desired degree of separation wa not achieved by the preliminary translation the system forces further separation between the foreground and background by taking the following action: (a) if the background was darker than the foreground, the background is made still darker and/or the foreground is made still lighter (b) if the background was lighter than the foreground the background is made still lighter and/or the foreground is made still darker.

DESCRIPTION OF THE DRAWINGS

FIGS. 1A, 1B and 1C show prior art systems.

DETAILED DESCRIPTION

Figure 2:
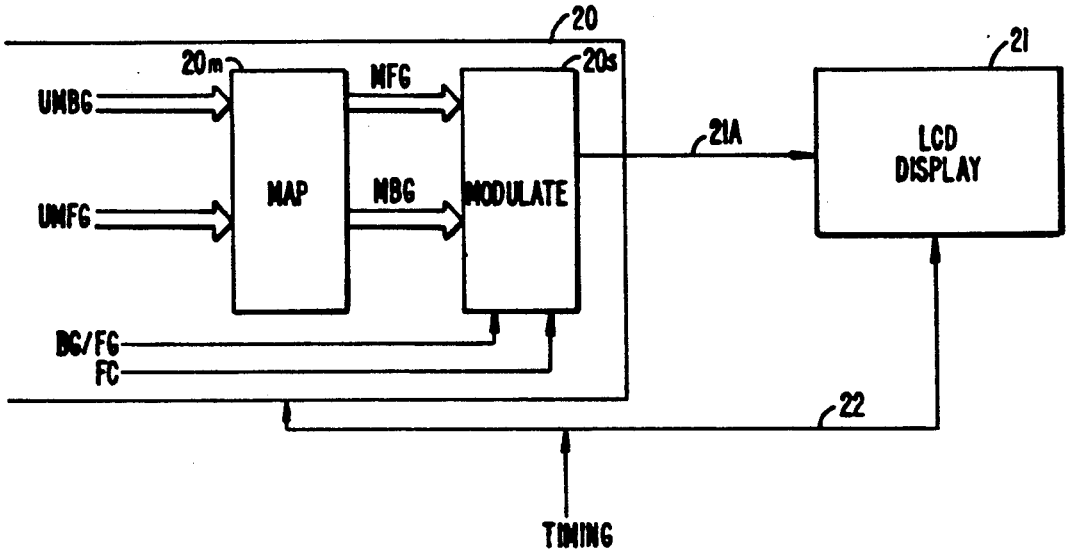
FIG. 2 shows a block diagram of a preferred embodiment of the present invention.

A block diagram of a preferred embodiment of the present invention is shown in FIG. 2. The system with which the present embodiment of the invention is designed to operate includes a commercially available IBM compatible personal computer (not specifically shown herein), and a commercially available LCD monochrome display 21.

The personal computer with which the present embodiment of the invention operates may be an IBM PC marketed by the IBM Corporation or it may be one of the IBM PC compatible computers that are commercially available from a wide variety of sources. The color graphics adapter 20 connects and interfaces to a personal computer (not shown herein) in a conventional manner via a standard PC bus. The interface between the personal computer and CGA 20 is explained in many commercially available publications and it is not particularly relevant to the present invention, hence, it is not explained in detail herein.

Figure 3:
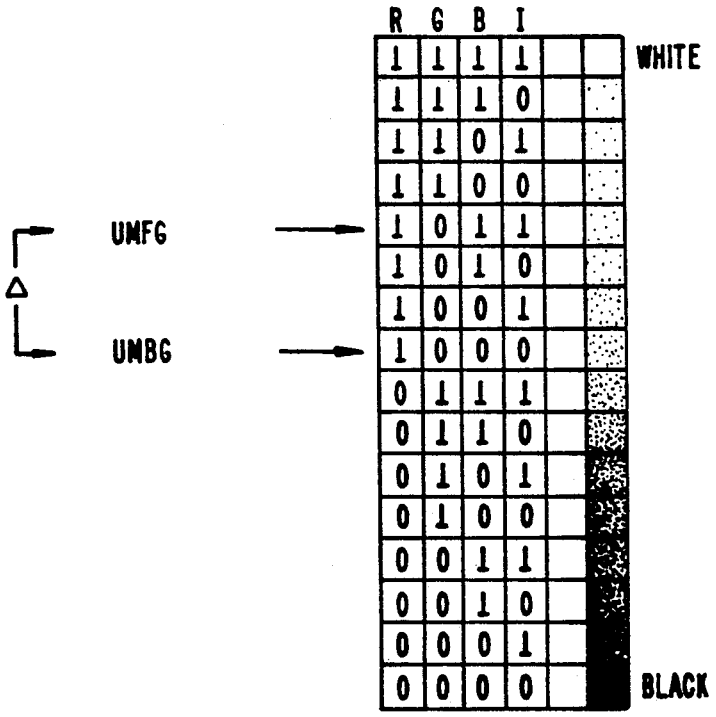
FIG. 3 shows the gray values obtained by the initial assignment of color signals to values of gray.

The LCD display 21 may be a commercially available LCD display such as that available with the IBM PC Convertible computer commercially marketed by IBM. It is well know that an LCD display can be made to show shades of gray by having pixels "on" during one cycle of the display and "off" during other cycles of the display. For example considering eight sequential refresh cycles of display 21, if a pixel is "on" for four cycles and "off" for four cycles, the pixel will appear gray. To eliminate flicker, the "on" and "off" cycles should alternate. If in an eight sequence cycle, a pixel is "on" for seven cycles and only "off" for one cycle, the pixel will be only slightly more gray than a pixel that is "on" for the entire eight cycles. The sequencing of pixels during sequential cycles is performed by circuit 20*s* which accepts the mapped signals MFG and MBG and a frame count signal FC and appropriately cycles the pixels "on" and "off" during sequential frames to generate shades of gray. It has been found that if an eight cycle period is considered, putting pixels "on" from between 0 to 8 of the cycles produces eight shades of gray as shown in FIG. 3. The signals MFG and MBG are used as numerical values for indicating how many cycles, that a pixel should be "on" and how many cycles the pixel should be "off". Given the numeric values in the MFG and MBG signals and the frame count signal (which can be generated by a simple counter), the circuitry in modulator circuit 20*s* sequences the pixel signals "on" and "off" over an appropriate number of frames. Circuit 20*s* also does the background-foreground selection in response to signal BG/FG. The operation and structure of circuit 20*s* is conventional and will not be explained further.

The present embodiment of the invention is directed to the CGA circuit 20 and more particularly to the parts of CGA 20 that translates the four background color bits UMBL and the four foreground color bits UMFG into the mapped signals MBG and MFG. The physical structure of the circuit 20 is not relevant to the present invention. What is significant is the logic performed. Circuit 20 could be physically implemented using any number of well known techniques such as by using a PLA, by using a programmed microprocessor or by using a custom logic integrated circuit chip.

As previously explained, the CGA adapter 20 when it is operating in text mode (which is the only mode of operation relevant to the present invention) generates signals that have eight color bits associated with each byte of data. Four of the color bits indicate the background color and four of the color bits indicate the foreground color. In FIG. 2, these signals are designated UMBL and UMFG (designating unmapped background color and unmapped foreground color).

The four color bits associated with the foreground and the four color bits associated with the background indicate whether the colors BLUE, GREEN, and RED, and the INTENSITY should be "on" or "off" when the foreground or the background of the associated byte of data is displayed. The four color bits provide sixteen combinations for the foreground color and sixteen combinations for the background color.

As a first step in the process of the present invention (a) the four bits that indicate foreground color are assigned a gray scale value and (b) the four bits that indicate the background color are assigned to a gray scale value. FIG. 3 shows the translation table used for the initial assignment of color designations to gray scale values. Thus as a first step, the present invention generates a particular foreground-background color combination or gray scale value in accordance with a fixed translation table. The translation table is shown in FIG. 3. Next the system determines if the initial assignment meets certain criteria. If the initial assignment does not meet the established criteria, the assignment is changed so that the criteria can, in so far as possible be met.

The initial assignment of gray scale values to the RED, GREEN, RED and INTENSITY bits is done by giving each of the color signals a binary value as shown in FIG. 3. The chart shown in FIG. 3 has the INTENSITY bit as the lowest binary value and the RED bit as the highest binary value, with the BLUE and GREEN bits having the second and third highest binary values. The assignment of numeric values to particular color bits is an arbitrary assignment and the embodiment would work with bits being given different numeric values. (the high order bit NF3 is used elsewhere as will be explained later and if the assignment were changed, one would use the high order bit of the new assignment for the NF3 signal). It is important to note that the color signals are assigned numeric values and that subsequent arithmetic operations are performed on these numeric values in order to enhance the contrast.

The criteria against which the results of the initial assignment are compared are established by a number of parameters that are set by the operator. The parameters set by the operator are the following:

| | |
|---|---|
| Kth | Threshold constant: This is a parameter that can be set by the operator to indicate a minimal acceptable separation between the foreground and background gray scale levels. |
| Kfg | Foreground Shift Constant: This is a parameter that can be set by the operator to indicate the amount that the foreground should be shifted if Kth is not met. |
| Kbg | Background Shift Constant: This is a parameter that can be set by the operator to indicate the amount that the background should be shifted if Kth is not met. |
| SAT | Saturation Control: This is a parameter set by the operator to indicate the type of arithmetic that should be used when numbers are being added. The differences that occur depending on the setting of this parameter with be explained later. |

Figure 4:
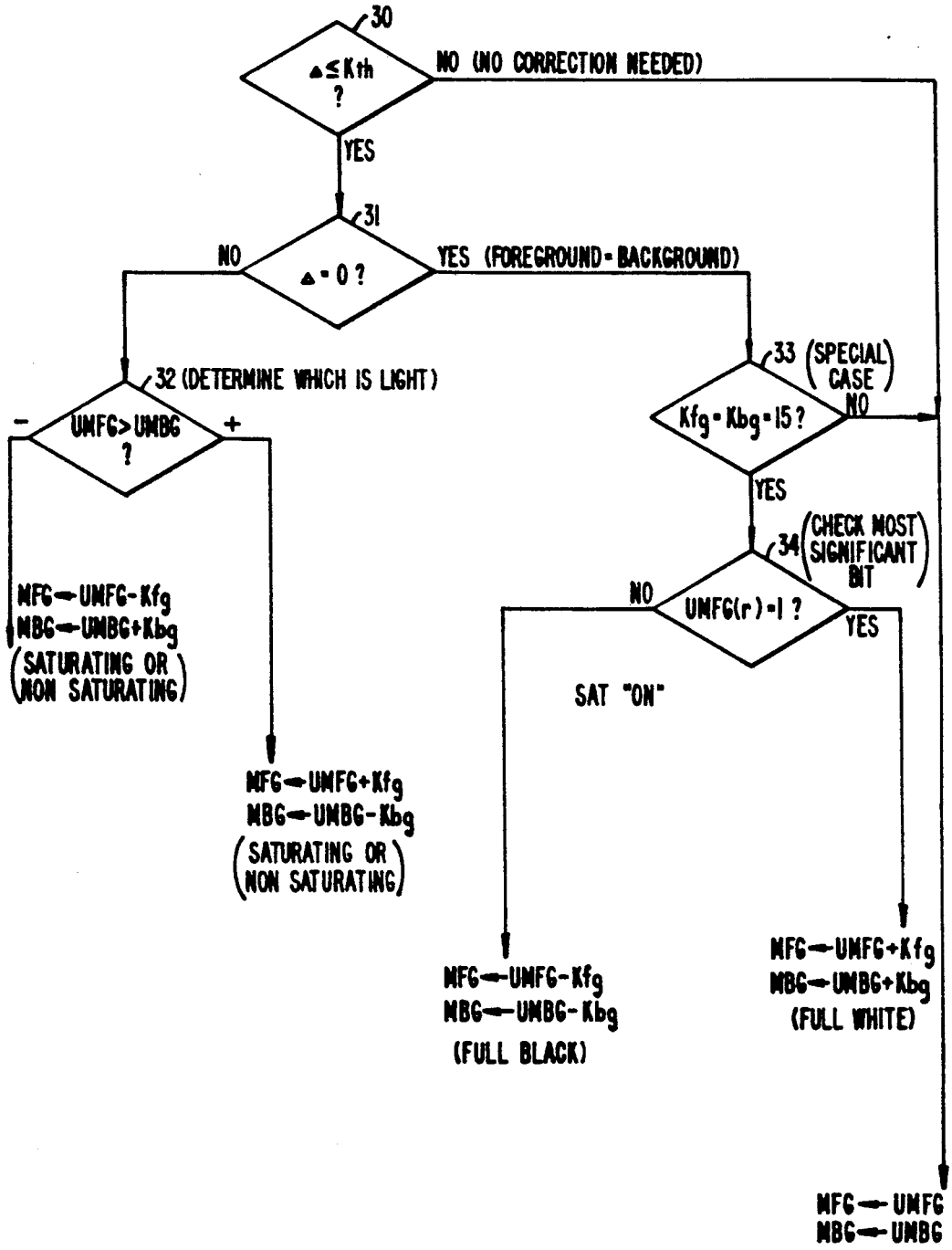
FIG. 4 is a flow diagram of the algorithm that implements the method and system of the present invention.

The steps used to insure that an initial assignment meets the established criteria is shown in FIG. 4. FIG. 4 also shows how the initial assignment is corrected if the results of the initial assignment do not meet the established criteria.

The following abbreviations are used in FIG. 4.

| | |
|---|---|
| UMFG | This is the unmapped foreground color signal that is generated in a conventional manner and provided by color graphics adapter 20 to mapping circuit 20 m. |
| UMBG | This is the unmapped background color signal that is generated in a conventional manner and provided by color graphics adapter 20 to mapping circuit 20 m. |
| MFG | This is the mapped foreground color signal that is generated by mapping circuit 20 m. |
| MBG | This the mapped background color signal that is generated by mapping circuit 20 m. |

Color Graphics adapter 20 generates four bit color control signals UMFG and UMBG in a conventional manner (not explained in detail herein). Signals UMFG and UMBG each have four bits representing RED, GREEN, BLUE and INTENSITY. Each time the color graphics adapter 20 generates a new eight bit color signal the algorithm (shown in FIG. 4) is performed.

One special case that is specifically accommodated is what is termed "convert to binary". This means that the parameters are set so that the display does not show shades of gray and all colors are converted to black or white. The operator indicates that he wants a conversion to binary by setting the control parameters a follows:

Kth to 15 (which is the maximum allowable value of Kth)

Kfg to 15 (which is the maximum allowable value of Kfg)

Kbg to 15 (which is the maximum allowable value of Kbg)

Sat to 1 (which means allow saturation and no wrapping)

As will be seen with the parameters set as shown above all colors are converted to either black or white. The algorithm used to test and if necessary modify the initial mapping is shown in FIG. 4. The algorithm operates as follows:

Block 30

The delta (D) between UMFG and UMBG as shown by the assignment table in FIG. 3 is calculated. If the calculated delta is larger than the parameter Kth, no translation is necessary and (a) MFG is set to UMFG and MBG is set to UMBG.

Block 31

If the delta between UMFG and UMBG equals zero, this indicates that the background color equals the foreground color and special action is taken as will be explained later with reference to blocks 33 and 34.

Block 32

A determination is made as to whether the background or the foreground is lighter. If UMFG is less than UMBG, the difference between the foreground and the background is increased by setting MFG to the value of UMFG less the parameter Kfg and setting MBG to the value of UMBG plus the parameter Kbg. If UMFG is larger than UMBG, the difference between the foreground and the background is increased by setting MFG to the value of UMFG plus the parameter Kfg and setting Mbg to the value of UMBG minus the parameter KBG.

BLOCK 33

This is a check for the special case where the operator has indicated that conversion to binary is desired. If Kfg and Kbg do not both equal 15, it means that conversion to binary is not desired. Where conversion to binary is not desired and the foreground color equals the background color, no shifting is performed. MFG is set equal to UMFG and MBG is set equal to UMBG.

BLOCK 34

This block comes into operation only in the case where the background equals the foreground and the operator has indicated that conversion to binary is desired. Where this special case is present, the value of the high order bit in the UMFG color is interrogated to determine if the unmapped signals are in the top or bottom half of the table shown in FIG. 3. Depending upon whether the signals are above or below the middle of the table, both the foreground and background colors are incremented or decremented in the same direction.

Figure 5:
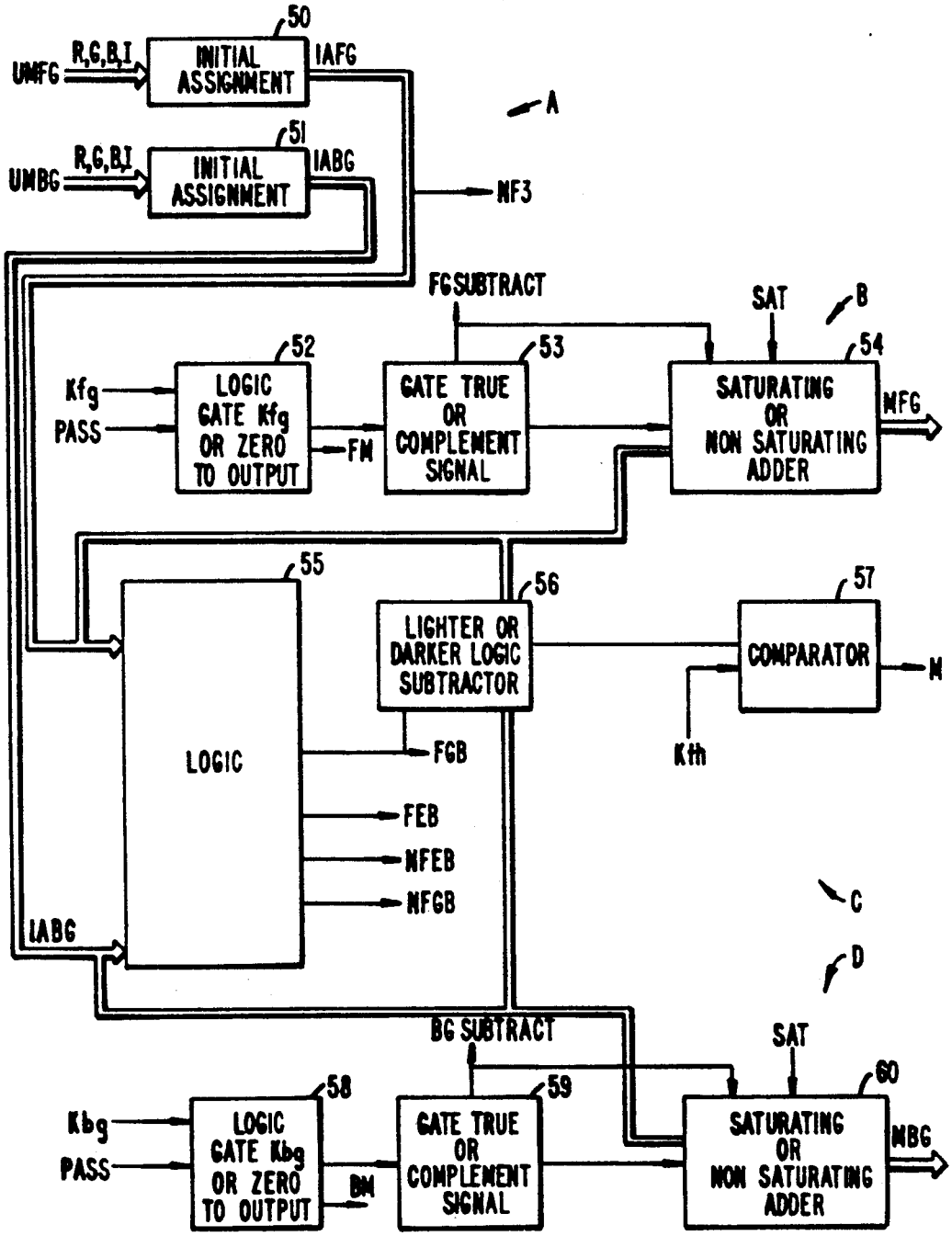
FIG. 5 is a logic circuit block diagram of a system built in accordance with the present invention.

A specific embodiment of hardware that implements the algorithm shown in FIG. 4 is shown in FIG. 5. It should be clearly understood that many other implementations are possible including the possibility of implementing the algorithm completely in software.

The hardware shown in FIG. 5 requires a number of control signals. These control signals are generated by conventional combinatorial logic (not specifically shown) according to the Boolean equations given below.

The first step in practicing the present invention is the unmapped foreground signal UMFG and unmapped background signal UMBG must be assigned gray scale values according to the table shown in FIG. 3. This assignment is done by merely assigning binary values to the RED, GREEN, BLUE and INTENSITY bits in the four bit color control signals generated in a conventional manner by the CGA 20. In the present embodiment, the bits are ordered as shown in FIG. 3. This for example means that the bit representing RED is assigned as the high order binary bit, the bit representing GREEN is assigned the next binary position, the bit representing BLUE is assigned the next binary position and the INTENSITY bit is assigned the low order binary position. This assignment is shown by blocks 50 and 51 in FIG. 5. It should be understood that in the simple case described here, blocks 50 and 51 merely in essence represent an ordering of the wires in the cables; however, a more complex initial mapping could be performed. The input is the conventional RED (R), BLUE (B), GREEN (G), and INTENSITY (I) bits, and the output is a numeric signal with these bits in a numerically ordered position.

The symbols used in the equations given below represent signals that have the following meaning.

M a signal generated by comparator 57 which indicates that the values determined in the initial assignment need be modified.

FM a signal generated by logic 52 which indicates that the foreground color assignment is at the maximum value.

BM a signal generated by logic 58 which indicates that the background color assignment is at the maximum value.

FEB a signal generated by logic 55 which indicates that the foreground color equals the background.

FGB a signal generated by logic 55 which indicates that the foreground value is larger than the background value.

NFEB a signal generated by logic which indicates that the foreground color does not equal the background color.

NFGB a signal generated by logic which indicates that the foreground color is not greater than the background color.

NF3 a signal which indicates that the high order bit of the IFG signal is not "on".

The signals required by the logic in FIG. 5 are as follows:

A signal designated PASS which is equal to:

[M and NFEB] or [M and FM and BM ]

A signal designated FGSUBTRACT which is equal to:

[M and NFEB and NFGB] or [FEB and FM and BM and NF3]

A signal designated BGSUBTRACT which is equal to:

[M and NFEB and FGB] or [FEB and FM and BM and NF3]

The logic in FIG. 5 has four main parts designated A, B, C, and D. Part A consists of blocks 50 and 51 and it does the initial assignment of gray values in accordance with the table shown in FIG. 3. The unmapped foreground and background color signals when they are ordered in accordance with the chart in FIG. 3 are designated IAFG and IABG respectively to indicate that they are the initially assigned foreground and background signals. Blocks 50 and 51 essentially represent a plug board where the bits representing RED, GREEN, BLUE, and INTENSITY are assigned binary values as shown in FIG. 3. This assignment is entirely arbitrary.

Part B which consists of blocks 52, 53 and 54 performs the modification of the foreground signal when appropriate. Depending on whether the PASS signal is active, logic 52 either passes Kfg or zero to block 53. Block 52 also generates signal FM according to the previously given definition. Block 53 in turn passes either its input or the complement thereof to block 54 depending on whether signal FGSUBTRACT is true. Finally block 54 does the appropriate addition to generate the MFG signal. Signal FGSUBTRACT goes to block 54 in order to enable the logic to correctly handle the overflow condition.

Part C which consists of blocks 55, 56 and 57 determines if the initial assignment needs to be changed. If the initial mapping needs to be changed, the M signal is generated by block 57. Block 55 is conventional logic that generates signals NFEB, FEB, and FGB in accordance with the previously given definitions. Block 56 subtracts the signals IABG and IAFG. Which signal is subtracted from which signal is determined by the value of signal FGB which indicates if the foreground is larger than the background. The output from block 56 is always positive and it represents the numerical difference between the initially assigned foreground and background signals. Block 57 compares the output of block 56 to the Kth signal to determine if the numerical difference (i.e. the delta) is larger than the threshold signal. If the numerical difference is smaller than the threshold signal, the M signal is generated.

Part D which consists of blocks 58, 59 and 60 performs the modification of the background signal when appropriate. Depending on whether the PASS signal is active, logic 58 either passes Kbg or zero to block 59. Block 58 also generates the signal BM according to the previously given definition. Block 59 in turn passes either its input or the complement thereof to block 60 depending on whether signal BGSUBTRACT is present. Finally block 60 does the appropriate addition to generate the MBG signal. Signal BGSUBTRACT goes to block 60 in order to enable the logic to correctly handle the overflow condition.

Circuits 53 and 59 together with circuits 54 and 60 in effect perform conventional saturating or non saturating addition or subtraction depending on the value of signal SAT. With respect to the chart in FIG. 3, saturating addition or subtraction means that when a number reaches the top or bottom of the chart, it stays at the maximum or minimum value. Non saturating addition means that wrap around occurs, that is when the sum of two numbers goes past the top or bottom of the chart in FIG. 3, the values wrap around to the other end of the chart.

The choice of value for the parameter SAT will depend upon the particular application of the system and upon the preference of the operator. The important point is that the system allows the operator this option.

The invention has been shown herein as applied to color signals generated by a CGA adapter. It should be understood that the invention is equally applicable to other adapters such as VGA and EGA adapters each of which produce color signals. With the present invention the color signals produced by any device can be assigned numeric values representing shades of gray. These values can be manipulated arithmetically and tested against criteria such as set points established by the operator. If the values do not satisfy the set criteria, the values are manipulated as arithmetic quantities in order to enhance the contrast.

While a particular embodiment of the invention has been shown and claimed, it should be clearly understood that the invention is not limited to the specific embodiment shown herein. Many modifications may be made without departing from the spirit and scope of the invention. The description of a specific embodiment is not meant to limit the scope of the invention. It is contemplated and specifically stated that the applicant's invention covers all modifications and alternatives to the specific embodiment shown which may fall within the words and spirit of the appended claims. It is to be fully understood that the description of a preferred embodiment is intended to be merely illustrative and is not to be construed or interpreted as being restrictive or otherwise limiting of the present invention.

I claim:

1. A method for mapping color signals into signals for driving a display which is capable of displaying shades of gray, comprising the steps of:

receiving a foreground color code and a background color code, each color code having a plurality of bits for controlling a presentation color of a character having a combination of said color codes;

translating both said foreground color code and said background color code, respectively, into a foreground numeric value and a background numeric value, each said numeric value indicating a particular level of gray;

producing a magnitude of a difference between said numeric values, said magnitude corresponding to a separation value for said combination of said color codes;

comparing said separation value to a predetermined threshold value to determine if said separation value is less than said predetermined threshold value; and adjusting said numeric values when said separation value is less than said predetermined threshold value.

2. A contrast enhancing circuit for translating color signals into signals for driving a display which is capable of displaying shades of gray, comprising:

means for receiving a foreground color signal and a background color signal;

means, coupled to said receiving means, for assigning, according to a predefined mapping table, a foreground numeric value representing a particular shade of gray to said foreground color signal and a background numeric value representing a particular shade of gray to said background color signal;

means, coupled to said assigning means, for generating a magnitude of a difference between said assigned foreground numeric value and said assigned background numeric value;

means, coupled to said generating means, for determining whether said magnitude of the difference is less than a predefined separation threshold; and means, coupled to said determining means, for altering said assigned foreground numeric value by a first predefined value on said assigned background numeric value by a second predefined value, when said magnitude of the difference is less than said predefined separation threshold.

3. The circuit of claim 2, wherein said altering means alters said assigned foreground numeric value by modifying said assigned foreground numeric value to represent a still darker shade of gray if said assigned foreground numeric value represents a darker shade of gray than said assigned background numeric value.

4. The circuit of claim 2, wherein said altering means alters said assigned background numeric value by modifying said assigned background numeric value to represent a still darker shade of gray if said assigned background numeric value represents a darker shade of gray than said assigned foreground numeric value.

5. The circuit of claim 2, wherein said altering means alters said assigned foreground numeric value by modifying said assigned foreground numeric value to represent a still lighter shade of grey if said assigned foreground numeric value represents a lighter shade of gray than said assigned background numeric value.

6. The circuit of claim 2, wherein said altering means alters said assigned background numeric value by modifying said assigned background numeric value to represent a still lighter shade of gray if said assigned background numeric value represents a lighter shade of gray than said assigned foreground numeric value.

7. A contrast enhancing method for mapping color signals into signals for driving a display which is capable of displaying shades of gray, comprising the steps of:

receiving a foreground color signal and a background color signal;

mapping initially, according to a predefined mapping table, said foreground color signal to a foreground numeric value, and said background color signal to a background numeric value;

determining a magnitude of a difference between said foreground numeric value and said background numeric value;

comparing said magnitude of the difference to a predefined threshold value to determine whether said magnitude of the difference is less than said predetermined threshold value; and altering one of said numeric values when said magnitude of the difference is less than said predefined threshold value.

8. The method of claim 7, wherein said altering step further comprises the step of:

altering said foreground numeric value to represent a still darker shade of gray if said foreground numeric value represents a darker shade of gray than said background numeric value.

9. The method of claim 7, wherein said altering step further comprises the step of:

altering said background numeric value to represent a still darker shade of gray if said background numeric value represents a darker shade of gray than said foreground numeric value.

10. The method of claim 7, wherein said altering step further comprises the step of:

altering said foreground numeric value to represent a still lighter shade of gray if said foreground numeric value represents a lighter shade of gray than said background numeric value.

11. The method of claim 7, wherein said altering step further comprises the step of:

altering said background numeric value to represent a still lighter shade of gray if said background numeric value represents a lighter shade of gray than said foreground numeric value.

12. A contrast enhancing circuit for translating color signals into signals for driving a display which is capable of displaying shades of gray, comprising:

a first initial assignment circuit for receiving a first plurality of signals representing a foreground color signal, and for assigning, according to a predefined mapping table, a foreground numeric value to said first plurality of signals;

a second initial assignment circuit for receiving a second plurality of signals representing a background color signal, and for assigning, according to said predefined mapping table, a background numeric value to said second plurality of signals;

a logic subtractor circuit, coupled to both said first initial assignment circuit and said second initial assignment circuit, for generating a magnitude of a difference between said foreground numeric value and said background numeric value;

a comparator, coupled to said logic subtractor circuit, for setting a modify flag when said magnitude of the difference is less than a predefined separation threshold value;

a first adder circuit, responsive to said modify flag, for adding a first predefined value to said foreground numeric value; and a second adder circuit, responsive to said modify flag, for adding a second predefined value to said background numeric value.

13. A contrast enhancing method for mapping color signals into signals for driving a display which is capable of displaying shades of gray, comprising the steps of:

receiving a foreground color signal and a background color signal;

mapping initially, according to a predefined mapping table, said foreground color signal to a foreground numeric value; and said background color signal to a background numeric value;

determining a magnitude of the difference between said foreground numeric value and said background numeric value;

comparing said magnitude of the difference to a predefined threshold value to determine whether said magnitude of the difference is less than said predetermined threshold value; and altering one of said numeric values when said magnitude of the difference is less than said predefined threshold value;

determining whether a mapping to binary is desired;

performing said desired mapping to binary by the steps of:

determining whether both said foreground numeric value and said background numeric value exceed a midpoint value between two extremes of said mapping table; and increasing both said foreground numeric value and said background numeric value to the maximum value of said mapping table if both exceed said midpoint value, otherwise decreasing both said foreground numeric value and said background numeric value to the minimum value of said mapping table.

14. A contrast enhancing method for mapping color signals into signals for driving a display which is capable of displaying shades of gray, comprising the steps of:

receiving a foreground color signal and a background color signal;

mapping initially, according to a predefined mapping table, said foreground color signal to a foreground numeric value, and said background color signal to a background numeric value;

determining a magnitude of the difference between said foreground numeric value and said background numeric value;

comparing said magnitude of the difference to a predefined threshold value to determine whether said magnitude of the difference is less than said predetermined threshold value;

altering one of said numeric value when said magnitude of the difference is less than said predefined threshold value;

determining whether saturation control is desired; and providing for saturation control enabling said numeric values to be altered past a first end of said mapping table to wrap around to a second end of said mapping table if, in the process of altering, either said foreground numeric value or said background numeric value exceed the range of values of said mapping table.

* * * * *